US005353895A

United States Patent [19]

Camack et al.

[11] Patent Number: 5,353,895

[45] Date of Patent: Oct. 11, 1994

[54] EMERGENCY BRAKING SYSTEM FOR HOISTS

[76] Inventors: Dermot E. Camack, 24 Allangrove Cres., Scarborough, Ontario, Canada, MIW 1T2; Shawn Clyne, 3 Henley Cres., Scarborough, Ontario, Canada, M9W 2W8; Kelvin Lo, 10 Greenhedges Crt., Scarborough, Ontario, Canada, M1B 1T2

[21] Appl. No.: 74,425

[22] Filed: Jun. 10, 1993

[30] Foreign Application Priority Data

Jun. 23, 1992 [CA] Canada ..... 2072187

[51] Int. Cl.[5] ..... B61H 7/12; B66B 5/16

[52] U.S. Cl. ..... 187/369; 187/375; 188/72.3; 188/72.7; 188/72.9; 188/170; 188/44

[58] Field of Search ..... 188/43, 44, 45, 72.3, 188/170, 72.7, 72.8, 72.9, 165, 187, 180, 196 V, 196 M, 71.7, 72.6, 106 R, 106 P; 187/86, 85, 90, 91, 93; 303/71

[56] References Cited

U.S. PATENT DOCUMENTS

| | | | |
|---|---|---|---|
| 1,252,737 | 1/1918 | Tanner | 187/85 |
| 1,756,370 | 4/1930 | Luehrman | 187/86 |
| 1,773,869 | 8/1930 | Schank et al. | 187/86 |
| 1,873,828 | 8/1932 | Dunlop | 187/86 |
| 1,874,754 | 8/1932 | James | 187/90 |
| 1,971,114 | 8/1934 | McCormick | 187/90 |
| 3,486,592 | 12/1969 | Kolk et al. | 188/44 |
| 3,635,315 | 1/1972 | Shalders | 188/44 |
| 3,780,837 | 12/1973 | Haydu | 188/170 |
| 3,972,392 | 8/1976 | Johnson | 188/43 |
| 4,060,152 | 11/1977 | Bogenschutz et al. | 188/107 |

FOREIGN PATENT DOCUMENTS

| | | | |
|---|---|---|---|
| 285314 | 12/1990 | Fed. Rep. of Germany | 188/170 |
| 1415398 | 12/1964 | France | 188/170 |
| 2565917 | 12/1985 | France | 188/43 |
| 1420959 | 1/1976 | United Kingdom | 188/170 |

*Primary Examiner*—Douglas C. Butler

[57] ABSTRACT

An emergency braking system for hoist cages, mounted for vertical travel between opposed guide rails, utilizes opposed pairs of pivoted brake application arms associated with braking web surfaces provided on the insides of the opposed hoist guide rails where each pair of brake application arms are provided, at one of their ends, with opposed pairs of braking surfaces associated with the webs and at their other ends with opposed cam follower rollers which, in turn, are associated with symmetrically opposed cam surfaced members which are mechanically connected to a spring biased hydraulic cylinder combination mounted for limited free lateral movement on the cage and located between the opposed pairs of brake application arms with the piston rod of the cylinder connected to one cam member and the cylinder per se to the other cam member. The cam member cam surfaces being arranged to apply spring braking pressure to the respective webs when the cylinder is not under pressure. Pressurizing the cylinder is effective to remove the braking pressure and cylinder pressure is maintained during normal hoist operation but is removed when a malfunction, such as over-speed or unauthorized movement of the hoist cage, is sensed.

8 Claims, 2 Drawing Sheets

EMERGENCY BRAKING SYSTEM FOR HOISTS

FIELD OF THE INVENTION

This invention relates to emergency braking systems for hoists and vertical lifts in general, the braking system designed to be applied automatically, or intentionally, in the case of unauthorized movement of the hoist cage in either vertical direction or in the case of over speed in any direction.

In the operation of hoist systems it is desirable to provide an emergency braking system which will operate automatically in case of a malfunction of the hoist system and stop movement of the hoist cage in either direction, even in the event of hoist lift cable failure. It is also desirable to prevent hoist cage movement over speed in either vertical direction since damage to equipment and personal injury may ensue. Accordingly, the emergency braking system should be actuated immediately on sensing the loss of control of the hoist system as indicated by the unauthorized movement of the hoist. "Unauthorized movement" means any movement of the hoist which is not initiated by and within set operational parameters of the control system of the hoist per se. Such unauthorized movement can be sensed by a hoist position and movement sensing and indicating system which is coupled to the control system of the emergency braking system to actuate same when unauthorized movement is sensed. The position and movement sensing system may be coupled to the control system for the hoist in such a manner that the emergency brake cannot be applied when authorized movement is taking place. It is also desirable to provide a fail safe braking system so that any failure in the control or braking system will actuate the brake.

The emergency braking system utilizes brake shoes, secured to and moveable with the hoist cage per se and which, when activated, cooperate with braking surfaces provided on the guide rails of the hoist. There are normally two or more such guide rails utilized in each hoist system.

PRIOR ART

Emergency braking systems are well known and used extensively. They normally comprise hoist cage mounted brake shoes which are spring biased to apply, when released, braking pressure to brake surfaces provided on the hoist cage guide rails. The brake shoes are generally in the form of wedges, cooperating with inclined guiding surfaces, which are, during braking action, direction sensitive such that a greater braking pressure is applied during downward movement of the hoist cage.

An example of such a braking system is shown in U.S. Pat. No. 3,635,315—Alan John Shalders—issued Jan. 18, 1972. This patent shows the use of spring biased, wedge shaped, brake shoes 2 which apply braking pressure to guide rails 25. The brake shoes cooperate with inclined surfaces in a manner to increase the braking pressure during downward or the tendency for movement downward of the hoist cage. The spring bias is provided by disc springs 24.

A further example of a braking system is provided in the June, 1992 issue of "ELEVATOR WORLD" at page 122. In this braking system oppositely disposed guide rail gripping means, comprising pivoted brake arm members or jaws, secured to the hoist cage, are associated with a braking web provided on each guide rail. Camming means, associated with each pair of brake arms and operated by release of a compressed helical spring, are utilized for brake application. The release of the brake is under control of a suspended-rope operated govenor. This system utilizes, expensive, complicated and separate mechanical means to compress and release the spring. In addition, the operation of a the brake is only responsive to speed of movement of the hoist.

DISCLOSURE OF THE INVENTION

According to the present invention a hoist braking system is provided which is, equally effective for braking hoist cage movement in either vertical direction, responsive to any unauthorized movement of the cage and utilizes an inexpensive unitary means to compress and release the brake. Furthermore, in the system according to the present invention, it is not necessary to provide adjustable eccentric pivot pins to compensate for brake wear, in fact, a single pivot pin can be used for each pair of brake arms.

The braking system utilizes dual brake shoes or pads positioned to apply braking pressure to opposing surfaces of a dual braking surfaced web provided on the hoist guide rail. For even and smooth braking the braking is applied to opposed hoist guide rails.

The brake shoes are supported on the outer ends of opposed, pivoted, brake arms, or jaws, provided with cam follower rollers located on their other ends, the pivots for the arms being located between the ends of the arms in a manner to provide lever advantage for the application of braking pressure. Braking pressure is applied by means of a double, opposed, ramp cam surfaces cooperating with the cam rollers to force the ends of the arms apart to, at the same time, move the brake shoes towards each other and squeeze the guide rail web braking surface therebetween. The pressure of the brake shoes against the braking surface is determined by the displacement of the roller ends of the brake arms which is, in turn determined by the cam surfaces and their total displacement with respect to the roller ends. The displacement of the cam surfaces is controlled by a spring bias system.

The spring bias system comprises one or more springs which are mechanically connected to a floating frame and brake rod mechanism whereby spring braking pressure may be applied equally, by virtue of mutual spring and frame movement, to opposed cams to, in turn, apply equal braking pressure to opposed hoist guide rails. A unique feature of the spring/frame system is that an initial spring tension, or compression, as the case may be, is provided by a hydraulic cylinder into which hydraulic fluid is pumped to set the spring, or springs. In so doing one end of the spring is moved linearly with respect to the frame, the other end of the spring being connected to the frame. During this movement, preferably compression of the spring is employed, the cam surfaces are displaced linearly with respect to the cam rollers, to displace the members of each brake shoe pair with respect to each other, i.e. removal of braking pressure. The shoes are held in this position by maintaining the fluid pressure in the cylinder. A light spring tension, applied between the ends of opposed brake arms, ensures that the brake shoes run free of the guide rail webs. Hoist cage braking is achieved by releasing the fluid medium from the hydraulic cylinder and the rapidity of brake application can be controlled by metering the out-flow of hydraulic fluid from the cylinder. An electrically powered pump is generally used for pressurizing the cylinder although this could be accomplished manually. Manual pump means can be provided for use in the case of power pump failure.

In order to control the actuation of the emergency braking system a hoist movement sensing arrangement is used. This sensing system can be of any known type and does not form a part of the present invention. For instance, a hoist overspeed detector, in the form of a mechanical govenor type, and separate cage position detectors can be utilized to sense unauthorized movement. These detectors can be designed to produce electrical control voltages which are applied to the control circuit of the present invention in such a manner as to indicate uncontrolled movement or over speed of the cage. It is only necessary that the proper signal voltage, indicating over speed or unauthorized movement, be supplied so that the emergency brake can be applied automatically in the event of dangerous over speed or unauthorized movement.

DETAILED DESCRIPTION OF THE INVENTION

Figure 1:
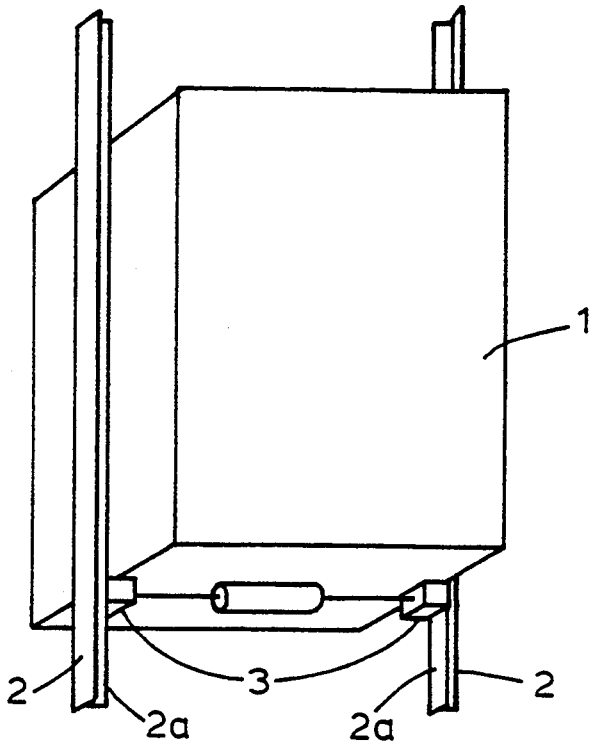
FIG. 1 is a depiction of an elevator system showing an elevator shaft with guide rails and a hoist cage system.

Referring now to FIG. 1, there is shown a hoist cage 1, guide rails 2 for the hoist and a schematic illustration of the mechanical part of the emergency braking system 3 which is mounted on the underside of the cage.

Figure 2:
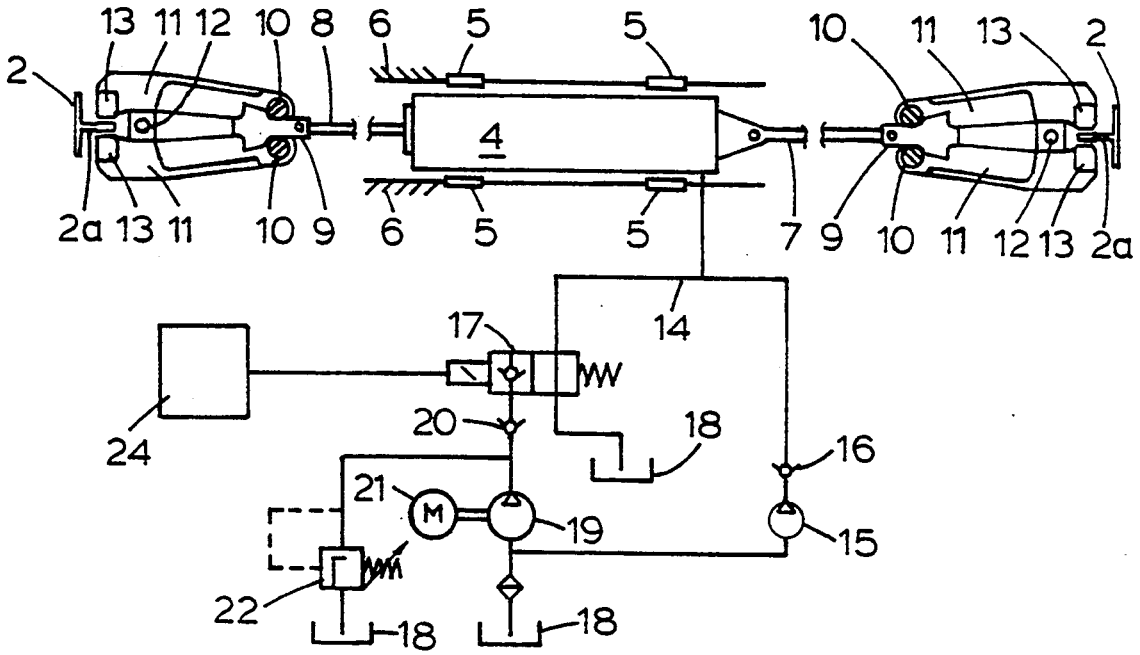
FIG. 2 shows a composite view of the elevator braking system according to the invention.

FIG. 2 shows the emergency braking system per se with a schematic diagram of the electrical and hydraulic control system therefor. The system comprises a hydraulic cylinder 4 which is mounted for lateral travel, on four rollers 5 which cooperate with tracks or guides 6, as the case may be, to allow limited lateral movement of the cylinder 4 with respect to tracks 6 and the cage, not shown, upon which the tracks are mounted to support the cylinder. The body of cylinder 4 is provided with a shaft connection 7 to a brake operating cam 9, to be described more fully later, on the right hand side of the figure. A piston rod 8, shown in extended position, is connected to a further brake operating cam 9 on the left hand side of the figure. Cams 9 cooperate with cam followers 10 provided on the inner ends of brake application arms 11, which arms are pivoted on pivot pins 12. The outer ends of the brake applications arms 11 are provided with opposed brake shoes 13 which, during brake application, are pressed against opposed braking-surfaced webs **2*a* provided on hoist guide rails 2. In the position shown in FIG. 2 the cam followers 10 are riding on the lowest profile of the cams and brake shoes 13 are clear of the braking surfaces. Hydraulic pressure, normally applied to cylinder 4, maintains piston rod 8 in its extended position against a return spring pressure, the spring not being shown here, and on release of the hydraulic pressure rod 8 is retracted by such spring pressure to operate the camming of the brake arms to apply braking pressure to the guide rails webs 2*a*. By virtue of the lateral travel provided for cylinder 4, braking pressure is provided equally to the cams 9 on each side of the hoist cage to guide rails 2**. The maximum braking pressure is determined by the strength of the piston rod return spring.

Referring now to the control circuit of the emergency brake, hydraulic fluid is supplied or withdrawn from cylinder 4 through a conduit 14. Conduit 14 is connected through a non-return valve 16 to a hand pump 15, in turn connected to a hydraulic fluid sump 18. Conduit 14 also connects to a, spring biased, electrically controlled, valve means 17 providing alternative conduit connections to sump 18 and a hydraulic pump 19, driven by a motor 21, which pump is also connected to sump 18. In the unenergized condition of valve 17, conduit 14 is connected sump 18. A non-return valve 20 is provided between sump 19 and valve 17. An overpressure relief valve system 22 is provided between the outlet of pump 19 and sump 18.

The braking system is moved to its released position, shown in FIG. 2, by hydraulic pressure being applied to cylinder 4 by either manual or power application. Once released the brake is held in that position by valves 16 and 17. The spring pressure, acting against the hydraulic pressure, may be provided by a spring incorporated in cylinder 4, which spring is compressed by the hydraulic fluid pressure and which, upon release of the hydraulic pressure, retracts piston rod 8 and by so doing applies retraction forces to each cam 9 to force apart cam followers 10, on each pair of brake arms, to press the brake shoes 13 against webs **2*a* of guide rails 2. A control circuit 24, acting on cage movement information, during normal controlled operation of the hoist, holds valve 17 energized preventing the return flow of oil from cylinder 4. A loss of electrical power or a non-authorized movement is effective, through control circuit 24, to deenergize valve 17 to allow hydraulic fluid in cylinder 4 to be dumped into sump 18** with the consequent application of the emergency brake.

Figure 3:
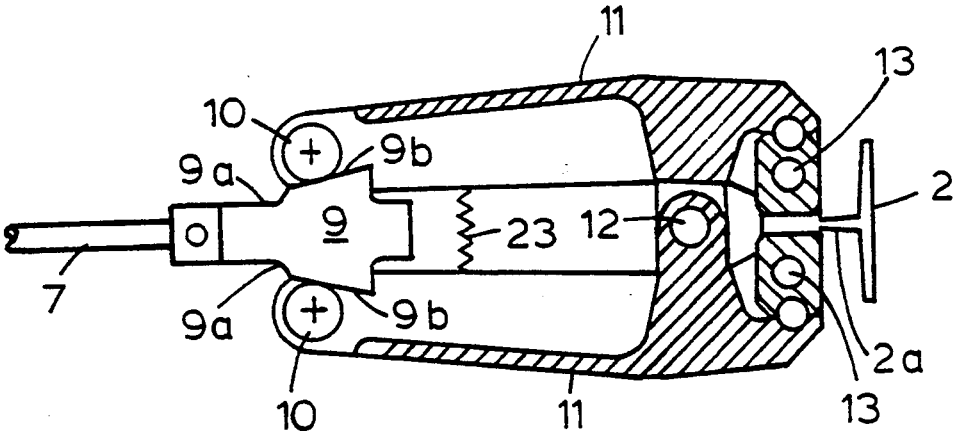
FIG. 3 shows the arrangement of opposed, pivoted brake arms and a cam system for operating the arms.

FIG. 3 shows, in greater detail, the, opposed, pivoted brake arms 11 and cam means 9. As shown in this figure cam 9 is provided with opposed cam surfaces **9*a*, 9*b* which show a steep sloped camming surface 9*a* and a more gradual sloped camming surface 9*b*. It is possible to provide the cam 9 in the form of a symmetrical body of revolution. The surface 9*a* is utilized to rapidly take up the free clearance between brake shoes 13 and the braking web 2*a* of rail 2. The lower slope of surface 9*b* provides for greater mechanical gain in the application of braking force after the initial contact of shoes 13 with the braking surfaces of webs 2*a*. A brake clearance spring 23** is provided to ensure that, under normal conditions of operation of the hoist, the brake shoes will run clear of the braking surfaces.

Figure 4:
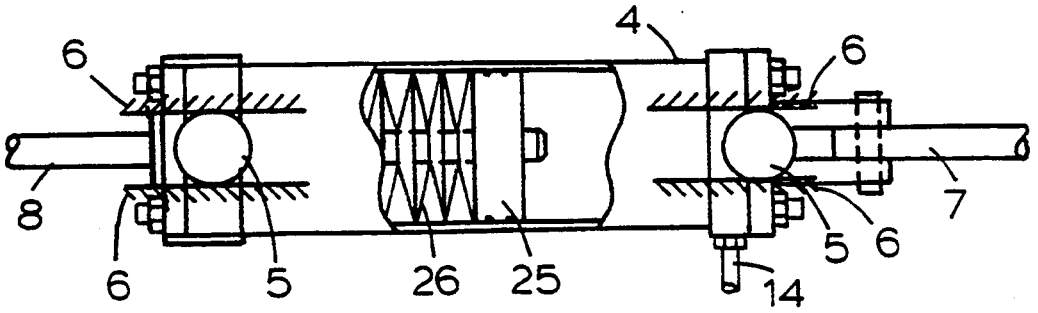
FIG. 4 shows a view of a hydraulic cylinder and spring combination for setting the braking system and operating the cam system.

Referring now to FIG. 4, there is shown a hydraulic cylinder 4 incorporating therewithin a set of spring washers 26 which bias piston 25, shown in cutaway, and piston rod 8 to their retracted position when no fluid pressure is applied, via conduit 14, to piston 25 in cylinder 4. Cylinder 4 is mounted for lateral movement on cage mounted tracks 6 by means of pin protrusions or, alternately, rollers, 5 fixed with respect to cylinder 4. As explained earlier the lateral movement allows equalization of braking force between the cams 9, i.e. sides of the cage.

Figure 5:
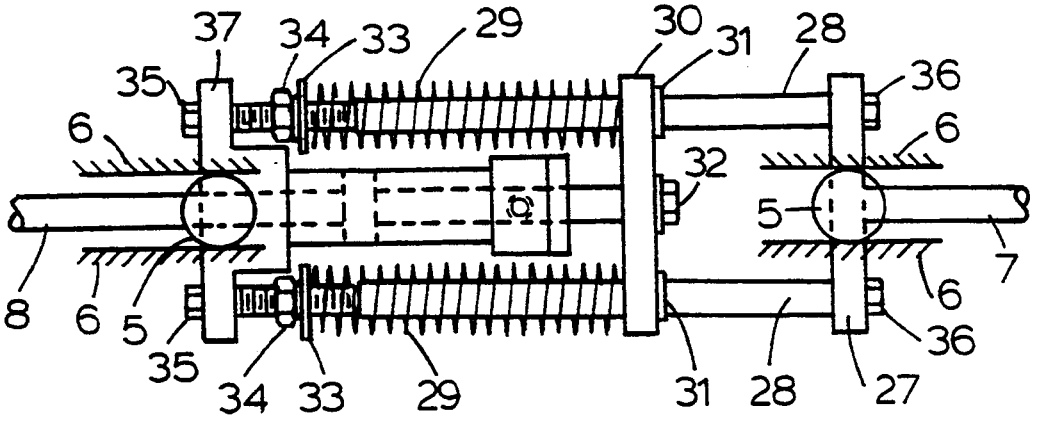
FIG. 5 shows a modification of the hydraulic cylinder and spring combination allowing greater adjustment of braking pressure.

Referring now to FIG. 5, a modification of the spring biased cylinder arrangement is shown. In this arrangement the spring biasing means for the hydraulic cylinder is provided externally to the cylinder. Two plates 27, 37, provided with rollers 5 for cooperating with the frame track 6 to facilitate brake equalization, are secured to each other by means of elongated bolts 28, 28 and retainer screws 35,36. Plate 37 is integral with one end of a double-piston-rod cylinder 40. As a consequence of this mechanical connection cylinder 40 moves in unison with end plates 27, 37 with respect to tracks 6 and the hoist cage per se.

Cylinder 40 is provided with a piston 25 and a piston rod 8 which extends from each end of the cylinder. The right hand end of piston rod 8 is secured, by means of screw 32, to a plate 30 which is provided with bearing sleeves 31 through which rods 28, 28 are slidable. Coil springs 29, encircling rods 28, 28, are held under pressure between plate 30 and washers 33. It will thus be seen that spring pressure is applied between cylinder 40 and piston rod 8 to bias the piston to the right hand end of the cylinder whereat hydraulic fluid may be supplied, via conduit 14, to move piston 25, and piston rod 8, to the left against spring pressure. The spring pressure is adjustable by means of nuts 34 thus allowing an adjustment of the maximum force to be applied to cams 9 during brake application. Although two springs 29 are shown it should be realized that a greater number can be employed to achieve a greater final braking pressure.

OPERATION OF THE BRAKING SYSTEM

The operation of the system is best exclaimed with reference to FIG. 2 wherein the system is shown in its cocked position, i.e. ready for the act of emergency braking. In this position the cams 9 are in their most extended position and the cam followers 10 ride on the lowest profile of the cam surfaces. The cocked position of the braking system is achieved by applying hydraulic fluid pressure, manually or preferably by powered pump 19, to cylinder 4 to fully extend piston rod 8. This position will be maintained as long as the pressure is maintained in cylinder 4 by non-return valves 16 and 20 and, of course, power pump 19 may be run continuously to ensure cylinder pressure is maintained. At this time valve 17 is energized by control circuit 24 to connect conduit 14 to valve 20, valve 17 connection to sump 18 being closed off.

If a malfunction occurs, i.e. the cage movement taking place is not authorized by the elevator control system, control circuit 24 senses the unauthorized movement and valve 17 is deenergized. The spring biasing of valve 17 moves it to connect conduit 14 to sump 18 resulting in a substantially immediate loss of fluid pressure in cylinder 4. If so desired, the rapidity of loss of pressure can be controlled to provide a more gradual application of braking pressure. Concurrently with the loss in pressure in the cylinder, piston rod 8 is retracted, by the pressure of the spring associated with cylinder 4, to shorten the overall length of the cylinder 4/piston rod 8 combination resulting in the movement of the cams inward with respect to the cage thus forcing cam rollers 10 up steep cam slopes 9*a*, to take up clearance between the brake shoes 13 and the braking web, onto less steep cam surfaces 9*b* whereat brake application commences, the final braking pressure being determined by the strength of the spring biasing means associated with cylinder 4. The braking pressure between sides of the cage is, of course, equalized by virtue of the lateral sliding of the cylinder/spring combination with respect to the cage. Braking pressure will be maintained until hydraulic fluid pressure is restored to cylinder 4 to compress spring washers 26 or helical springs 29, as the case may be. It will be obvious that a loss of electrical power will result in the deenergization of valve 17 and consequent emergency brake application.

Circuits responsive to sense unauthorized movement of a hoist cage are known and any suitable such circuit may be utilized in this system to effect emergency braking. Furthermore modifications of the embodiments shown may be made which do not depart from the spirit and scope of the present invention as defined in the appended claims. For instance, in the embodiment shown in FIG. 5, the return spring for the piston rod may be incorporated between plate 30 and the adjacent end of cylinder 40 and if adjustment is required plate 30 can be movable with respect to the end of piston rod 8 by threading the end of the rod where it passes through plate 30 and substituting a nut for retainer bolt 32. Furthermore shaft 7 and rod 8 may be made adjustable, by known means to accommodate different cage widths and other variations.

THE EMBODIMENTS OF THE INVENTION IN WHICH AN EXCLUSIVE PROPERTY OR PRIVILEGE IS ARE DEFINED AS FOLLOWS:

We claim:

1. An emergency braking system for a hoist for preventing unauthorized movement of a hoist cage guided by opposed cage-side guide rails wherein the guide rails are each provided with an inwardly projecting web with a braking surface on each side of the web, comprising two pairs of opposed, pivoted, brake application arms, each pair of arms having outer ends provided with oppositely disposed brake pads associated, in clamping arrangement, with the braking surfaces of one of the webs and inner ends provided with oppositely disposed cam follower surfaces, the pivot points of each said pair of arms being located intermediate the ends of the said pair of arms and secured to the cage, two camming means, each provided with oppositely disposed camming surfaces, each one of the said camming means being individually and operatively associated in cooperating arrangement with the cam follower surfaces of one of said pair of arms, a hydraulic-fluid-operated cylinder, located between the said two pairs of arms and secured to the cage to allow limited lateral movement of the cylinder with respect to the cage, the cylinder being provided with a piston with an associated, projecting, piston rod, the said cylinder being mechanically connected to one of the said camming means and the said piston rod mechanically connected to the other of the said camming means, spring pressure means being associated with the said cylinder to pressure bias the piston rod to a retracted position with respect to the cylinder whereat the said camming means are each pulled laterally inward, with respect to the cage, to move the oppositely disposed cam follower surfaces of each pair of arms with respect to each other to produce spring pressure application of the said brake pads to the web associated therewith and wherein means is provided to pressurize the said cylinder with hydraulic fluid to extend the said piston rod from the said cylinder, against spring pressure, to release the spring pressure on the said brake pads, there being control means provided to release the fluid pressure from the cylinder.

2. The emergency braking system as defined in claim 1, wherein the said spring pressure means is enclosed within the cylinder.

3. The emergency braking system as defined in claim 1, wherein the said spring pressure means is external to the cylinder and further means is provided for adjusting the spring pressure application of the said brake pads to the said webs.

4. The emergency braking system as claimed in claim 1, wherein the said camming means are each provided with opposed stepped camming surfaces to produce an initial rapid movement of the cam follower surfaces of a said pair of arms with respect to each other, followed by a, less rapid, further movement during a brake application initiated by a release of fluid pressure from the said cylinder.

5. An emergency braking system for a hoist system provided with a hoist cage and oppositely disposed guide rails therefor, comprising, an inwardly directed, braking surfaced, web provided on each guide rail, two pairs of brake application arms, one of said pairs being associated with one of said guide rails and the other of the said pairs being associated with the other of said guide rails, the arms of each of the said pairs being in opposed, pivoted, arrangement with the pivot point of each said pair of arms secured to the cage, each of said pairs of arms having two oppositely disposed outer ends provided with brake pads closely associated in clamping arrangement with the web of the associated guide rail, the other ends of each of the said pairs of arms being provided with oppositely disposed cam follower surfaces, two camming means provided with symmetrically opposite camming surfaces, the said camming surfaces being, individually and operatively associated with the said cam follower surfaces, a hydraulic cylinder secured to the hoist cage for limited lateral movement with respect thereto and between the said guide rails, the cylinder being mechanically connected to one of the said camming means and an operative piston rod of the cylinder being mechanically connected to the other of the said camming means, a spring pressure means associated with the said cylinder to bias the piston rod thereof to a retracted position, with respect to the said cylinder, for reducing the separation of the said camming means and producing spring pressure application of the said brake pads to said webs, means to supply hydraulic fluid pressure to the cylinder to extend the said piston rod from said cylinder and produce greater separation of the said camming means, with respect to each other and separation of the brake pads of each of said pairs of arms, and means to release the fluid pressure from the cylinder to initiate retraction of the piston rod with respect to the cylinder and reduction of the separation of the said camming means whereby the said camming surfaces cooperate with the said cam follower surfaces to produce brake pad clamping on the web of each said guide rail.

6. The emergency braking system as claimed in claim 5, wherein the camming surfaces of each said camming means are oppositely stepped to provide an initial rapid closure movement of the brake pads of each said pair of arms and a subsequent less rapid further closure of said brake pads.

7. The emergency braking system as claimed in claim 5, wherein the spring pressure means comprises one or more springs symmetrically disposed about the said hydraulic cylinder and arranged to provide a retraction force for the piston rod of the said hydraulic cylinder, and further means being provided for adjustment of the retraction force of the spring pressure means.

8. The emergency braking system as claimed in claim 5, wherein control circuitry is provided to sense unauthorized cage movement and release fluid pressure from the said hydraulic cylinder.

* * * * *